US008256977B2

(12) United States Patent
Takahashi et al.

(10) Patent No.: US 8,256,977 B2
(45) Date of Patent: Sep. 4, 2012

(54) PRINTING DEVICE

(75) Inventors: Toshihiro Takahashi, Nagoya (JP); Keiji Seo, Nagoya (JP); Shinji Kobayashi, Tokoname (JP); Atsushi Kasugai, Nagoya (JP); Takehiko Inaba, Obu (JP); Hidenori Jo, Nagoya (JP); Hiroaki Kita, Nagoya (JP)

(73) Assignee: Brother Kogyo Kabushiki Kaisha, Nagoya-Shi, Aichi (JP)

( * ) Notice: Subject to any disclaimer, the term of this patent is extended or adjusted under 35 U.S.C. 154(b) by 304 days.

(21) Appl. No.: 12/724,536

(22) Filed: Mar. 16, 2010

(65) Prior Publication Data

US 2010/0260528 A1 Oct. 14, 2010

(30) Foreign Application Priority Data

Apr. 10, 2009 (JP) ..... 2009-095600

(51) Int. Cl.
*B41J 29/02* (2006.01)

(52) U.S. Cl. ..... 400/694; 400/691

(58) Field of Classification Search ..... 400/694
See application file for complete search history.

(56) References Cited

U.S. PATENT DOCUMENTS

| | | | | | |
|---|---|---|---|---|---|
| 4,630,149 | A | * | 12/1986 | Ida | 360/96.4 |
| 5,193,919 | A | | 3/1993 | Godo et al. | |
| 5,454,650 | A | * | 10/1995 | Yamaguchi | 400/208 |
| 5,730,536 | A | | 3/1998 | Yamaguchi | |
| 5,905,514 | A | * | 5/1999 | Rhoads et al. | 347/33 |
| 6,007,263 | A | * | 12/1999 | Imai et al. | 400/693 |
| 6,491,454 | B1 | * | 12/2002 | Toyosawa et al. | 400/83 |

FOREIGN PATENT DOCUMENTS

| | | |
|---|---|---|
| EP | 1698476 | 9/2006 |
| JP | 7314864 | 12/1995 |

* cited by examiner

*Primary Examiner* — Anthony Nguyen
(74) *Attorney, Agent, or Firm* — McCarter & English, LLP

(57) ABSTRACT

A printing device loads a tape cassette including a label, a tape transfer roller, and a shaft hole, and the printing device includes a first synthetic resin support shaft that is fitted in the shaft hole to support the tape transfer roller, a synthetic resin frame that anchors a lower part of the first support shaft, a second synthetic resin support shaft that stands on the frame on the opposite side of the first support shaft, a first gear that is provided on the second support shaft to be rotated by driving power from a motor in the printing device, a second gear that engages with the first gear and biased toward the first gear, and a press roller that includes the second gear, rotates, and is biased toward the first support shaft to hold the label between itself and the tape transfer roller and to discharge the label.

1 Claim, 14 Drawing Sheets

PRINTING DEVICE

CROSS-REFERENCE TO RELATED APPLICATION

The present application claims priority from JP 2009 095600, filed on Apr. 10, 2009, the content of which is hereby incorporated herein by reference in its entirety.

BACKGROUND

The present disclosure relates to a printing device. More particularly, it relates to a printing device that discharges a printed label to the outside.

The present disclosure relates to a printing device. More particularly, it relates to a printing device that discharges a printed label to the outside.

Conventionally, printing devices having a tape cassette detachably loaded therein to produce tape-like labels are known. The tape cassette used in the printing device includes therein, for example, a transparent film tape on which letters and the like are printed, and a double sided adhesive tape bonded to the backside of the transparent film tape after the printing. A tape transfer roller is provided near a tape discharge port of the tape cassette for discharging the transparent film tape after the printing and the double sided adhesive tape bonded together to the outside.

This printing device includes a tape drive cam fitted in a shaft hole provided in the tape transfer roller, and a press roller rotatably attached to a position opposite the tape drive cam. When printing, the transparent film tape after the printing and the double sided adhesive tape are held and pressed together between the tape transfer roller and the press roller, and discharged to the outside.

The tape drive cam is generally composed by a tape drive cam gear, a cam member, and a tape drive cam support shaft made of metal and provided at the center of the tape drive cam. The tape drive cam gear and the cam member are formed integrally with each other and provided on an outer circumference of the tape drive cam support shaft. The lower part of the tape drive cam support shaft is fixed by a metal frame.

When the tape cassette is loaded in the printing device, the tape drive cam fits in the shaft hole in the tape transfer roller, whereby the tape transfer roller is appropriately positioned. Driving power from the motor is transmitted to the tape transfer roller of the tape cassette via the tape drive cam gear and the cam member. Thus the tape transfer roller rotates.

Generally, a press roller gear is provided under the press roller. The press roller gear is biased toward the tape drive cam gear to engage with the same. The press roller presses the tape transfer roller through the transparent film tape and the double sided adhesive tape. During printing, driving power from the motor is transmitted to the press roller gear via the tape drive cam gear. This rotates the press roller gear and the press roller. The tape transfer roller also rotates. Thus the printed tape and the double sided adhesive tape are held and pressed together between the tape transfer roller and the press roller and discharged to the outside.

In this conventional printing device described above, as the press roller presses the tape transfer roller provided in the tape cassette, a large pressure is applied to the tape drive cam that supports the tape transfer roller. The tape drive cam support shaft, which is the center axis of the tape drive cam, is therefore subjected to a large pressure. The press roller gear is biased toward the tape drive cam gear to engage with the same. Therefore, the pressure from the press roller gear is applied to the tape drive cam support shaft via the tape drive cam gear. That is, the pressure from the press roller and the pressure from the press roller gear are both applied to the tape drive cam support shaft. Any pressure applied to the tape drive cam support shaft also causes a force to be applied to the frame that anchors the tape drive cam support shaft. Therefore, the tape drive cam support shaft and the frame that anchors the tape drive cam support shaft are required to have high strength. Accordingly, metal having high strength is used for the tape drive cam support shaft and the frame.

SUMMARY

However, metal is high in production cost and heavy in weight. If the tape drive cam support shaft and the frame were made of synthetic resin, they could be produced at a lower cost as compared to the case with metal, and also their weights could be made lighter. However, since synthetic resin has lower strength than metal, the pressure applied to the tape drive cam support shaft may cause the tape drive cam support shaft to tilt, or cause the frame anchoring the tape drive cam support shaft to warp. The problem was that, because of this, the tape transfer roller provided in the tape cassette could not be retained in an appropriate position, and the printed label tape could not be smoothly pressed together and discharged to the outside.

The present disclosure was made to solve the above described problem, its object being to provide a printing device having a support shaft fitted in a shaft hole of a tape transfer roller, and a frame anchoring the support shaft, both made of synthetic resin, yet being able to retain the tape transfer roller in an appropriate position so as to smoothly press the printed label tape and discharge it to the outside.

To solve the problem, in a aspect of this disclosure, a printing device detachably loading a tape cassette which includes a label forming a printing medium, a rotatable tape transfer roller discharging the label to the outside, and a shaft hole provided in the tape transfer roller, the printing device including a first support shaft that is made of synthetic resin and is fitted in the shaft hole to rotatably support the tape transfer roller, a frame that is made of synthetic resin and anchors a lower part of the first support shaft, a second support shaft that is made of synthetic resin standing on the frame on the opposite side of the first support shaft, a first gear that is rotatably provided around an outer circumference of the second support shaft to be rotated by driving power transmitted from a motor provided in the printing device, a second gear that engages with the first gear and biased toward the first gear, and a press roller that includes the second gear, rotates by driving power transmitted through the second gear, and is biased toward the first support shaft to hold the label between itself and the tape transfer roller and to discharge the label to the outside.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Hereinafter the tape printing device 1 that is one embodiment of the disclosure will be described with reference to the drawings. The drawings referred to are used for purposes only of explaining technical features that can be adopted in this disclosure. The description of the structures and the like of the device is not intended to limit the disclosure to the particular forms disclosed herein but these specific structures are only examples.

Figure 1:
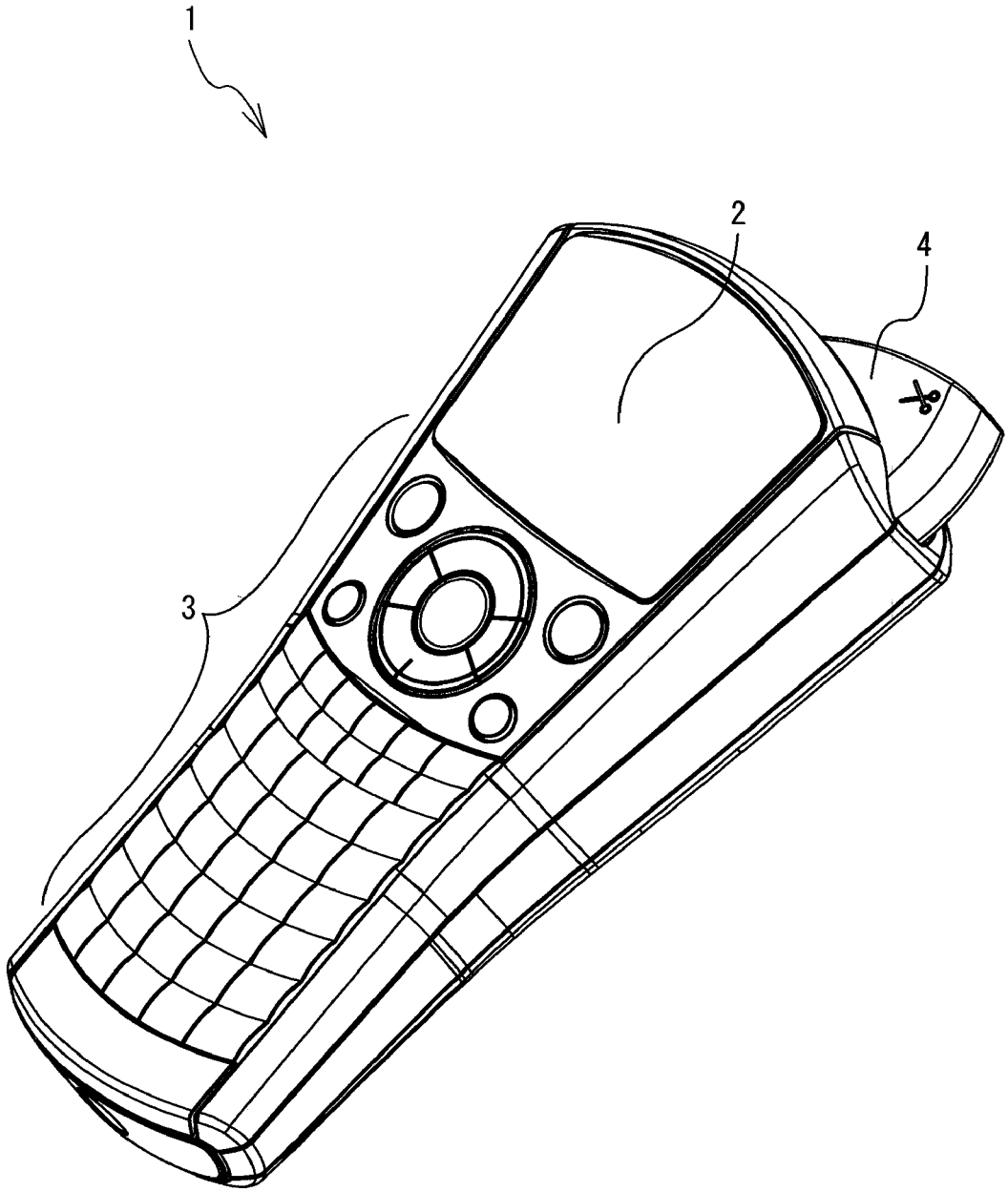
FIG. 1 is a perspective view of a tape printing device.
Figure 2:
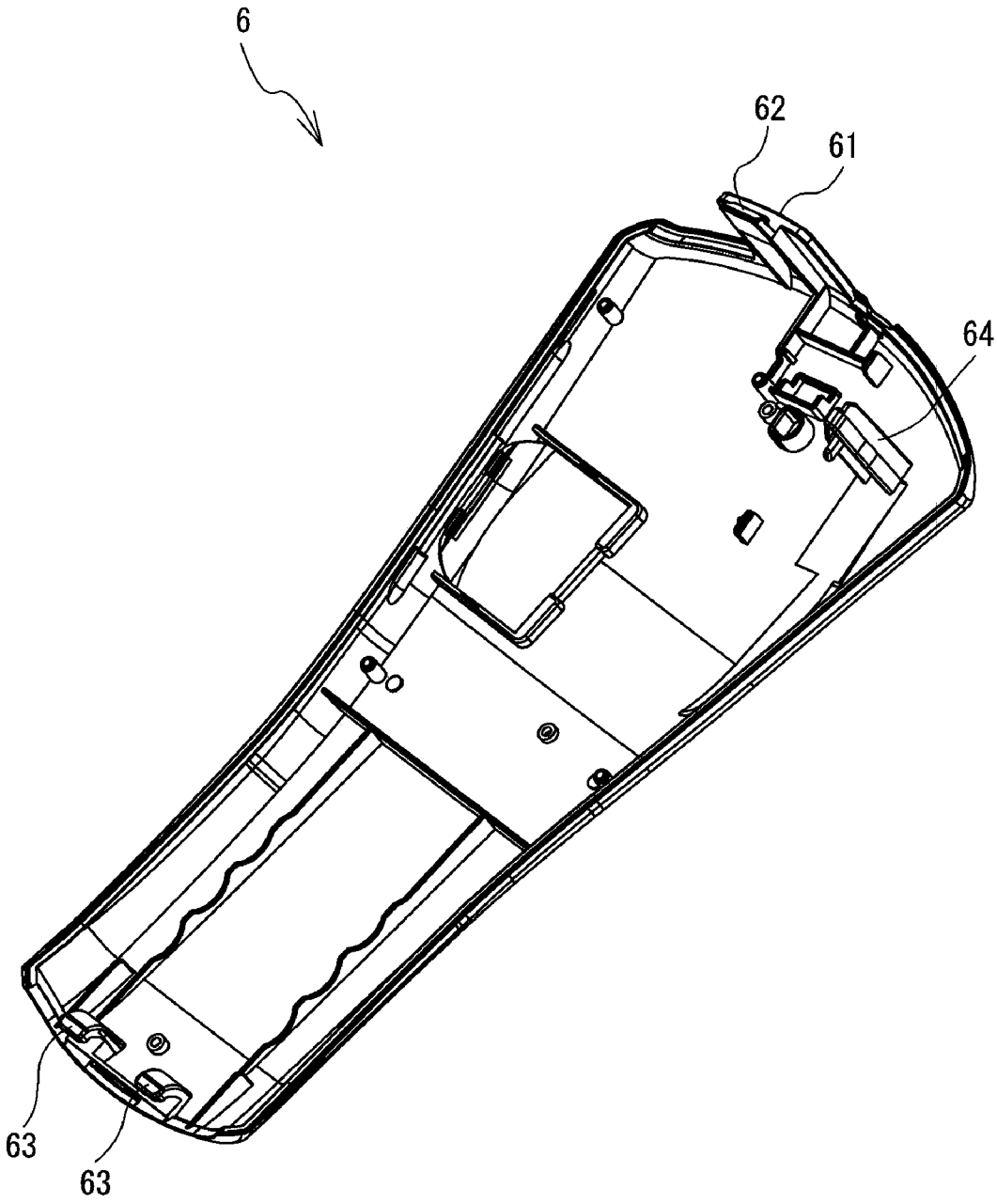
FIG. 2 is a perspective view of a lower cover removably attached to a bottom face of the tape printing device.

The overall structure of the tape printing device 1 will be described with reference to FIG. 1 to FIG. 8. In the following description, the upper right side in FIG. 1 and FIG. 2 is referred to as the backside of the tape printing device 1, the lower left side as the front side of the tape printing device 1, the lower right side as the right side of the tape printing device 1, and the upper left side as the left side of the tape printing device 1. The near side in the figures is referred to as the upper side of the tape printing device 1, and the far side as the lower side of the tape printing device 1.

As shown in FIG. 1, the tape printing device 1 is formed in a generally rectangular parallelepiped shape. A LCD 2 for displaying data to be printed and a setting screen or the like is provided at the back (upper right side in FIG. 1) on the upper face of the tape printing device 1. A keyboard section 3 for operating the tape printing device 1 is provided on the front side (lower left side in FIG. 1) of the LCD 2. The keyboard section 3 includes character keys such as letters, symbols, and numbers, and various function keys. On the backside of the tape printing device 1, there is provided a tape delivery slit 24 (see FIG. 3) from which a label tape 80 (see FIG. 9) after the printing is discharged. A cut button 4 for cutting the printed label tape 80 in a widthwise direction is provided on the right part on the back side face of the tape printing device 1.

The lower cover 6 forming the lower face of the tape printing device 1 will be described with reference to FIG. 2. The lower cover 6 has the same shape as the tape printing device 1 in top plan view. The lower cover 6 is detachably attached to the tape printing device 1. By removing the lower cover 6 from the tape printing device 1, the tape cassette 31 (see FIG. 9) or dry cell batteries 8 (see FIG. 3) can be replaced. A locking wall 61 stands at the back of the lower cover 6. The locking wall 61 is rectangular when viewed from the back side face and has a hook-like engaging lock 62 at the top. At the front of the lower cover 6, hook-like lock members 63 are provided at two locations. In the bottom face of the tape printing device 1, with the lower cover 6 being removed therefrom, a lock hole 11 (see FIG. 3) is provided at a location corresponding to the engaging lock 62. Two lock holes 12 (see FIG. 3) are provided at locations corresponding to the two lock members 63. When the lower cover 6 is attached to the tape printing device 1, the lock members 63 fit in the lock holes 12, while the engaging lock 62 fits in the lock hole 11. Thereby, the lower cover 6 is prevented from opening on its own.

A projection 64 is provided to the right side in front of the locking wall 61. The projection 64 is inserted to and extracted from a later-described projection insertion hole 10 (see FIG. 3) when the lower cover 6 is attached or removed. It causes a later-described roller holder 17 to move to a printing position (see FIG. 12) or to a wait position (see FIG. 11). The roller holder 17 will be described in detail later.

Figure 3:
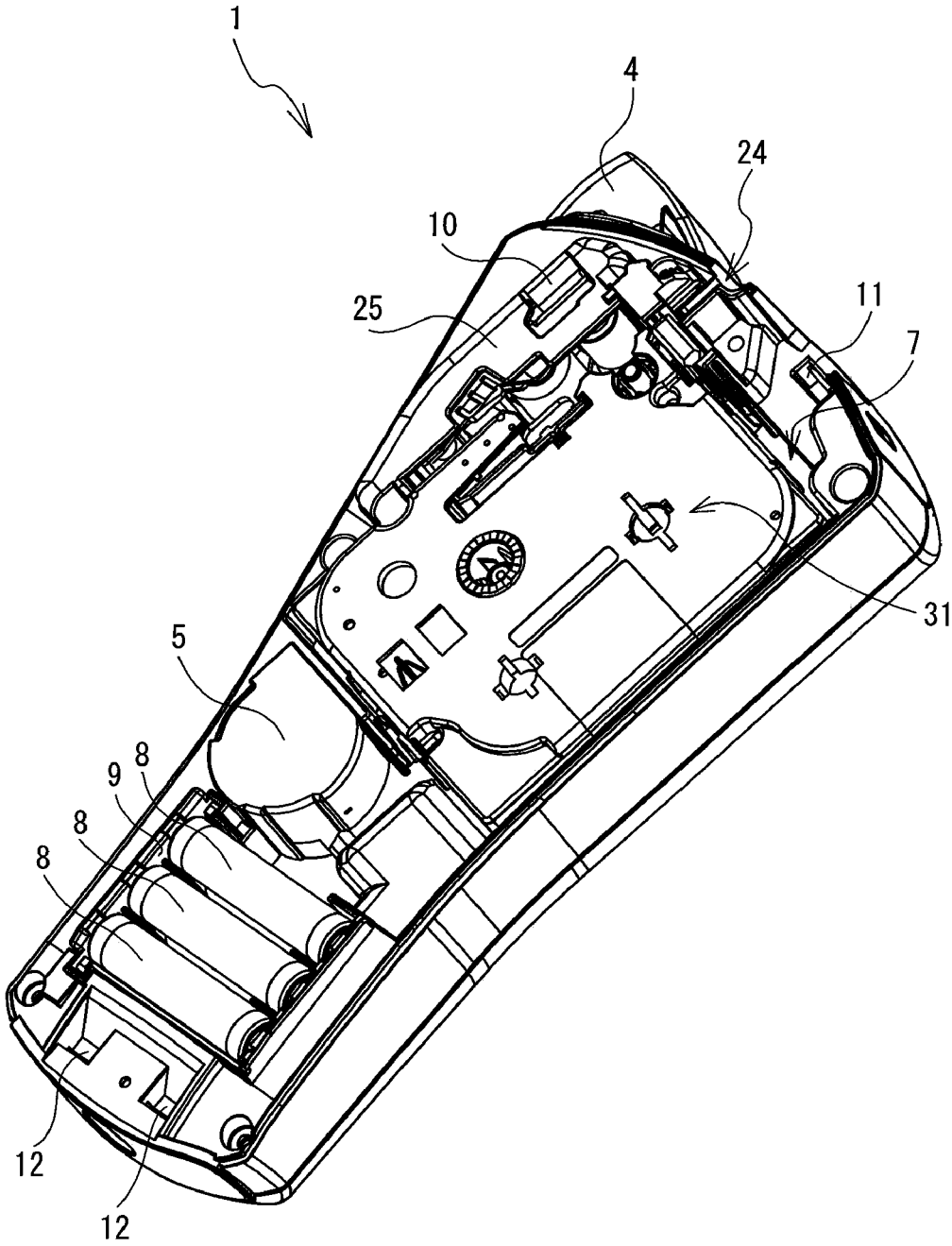
FIG. 3 is a perspective view from the bottom side of the tape printing device in a state in which a tape cassette is loaded and the lower cover is removed.
Figure 4:
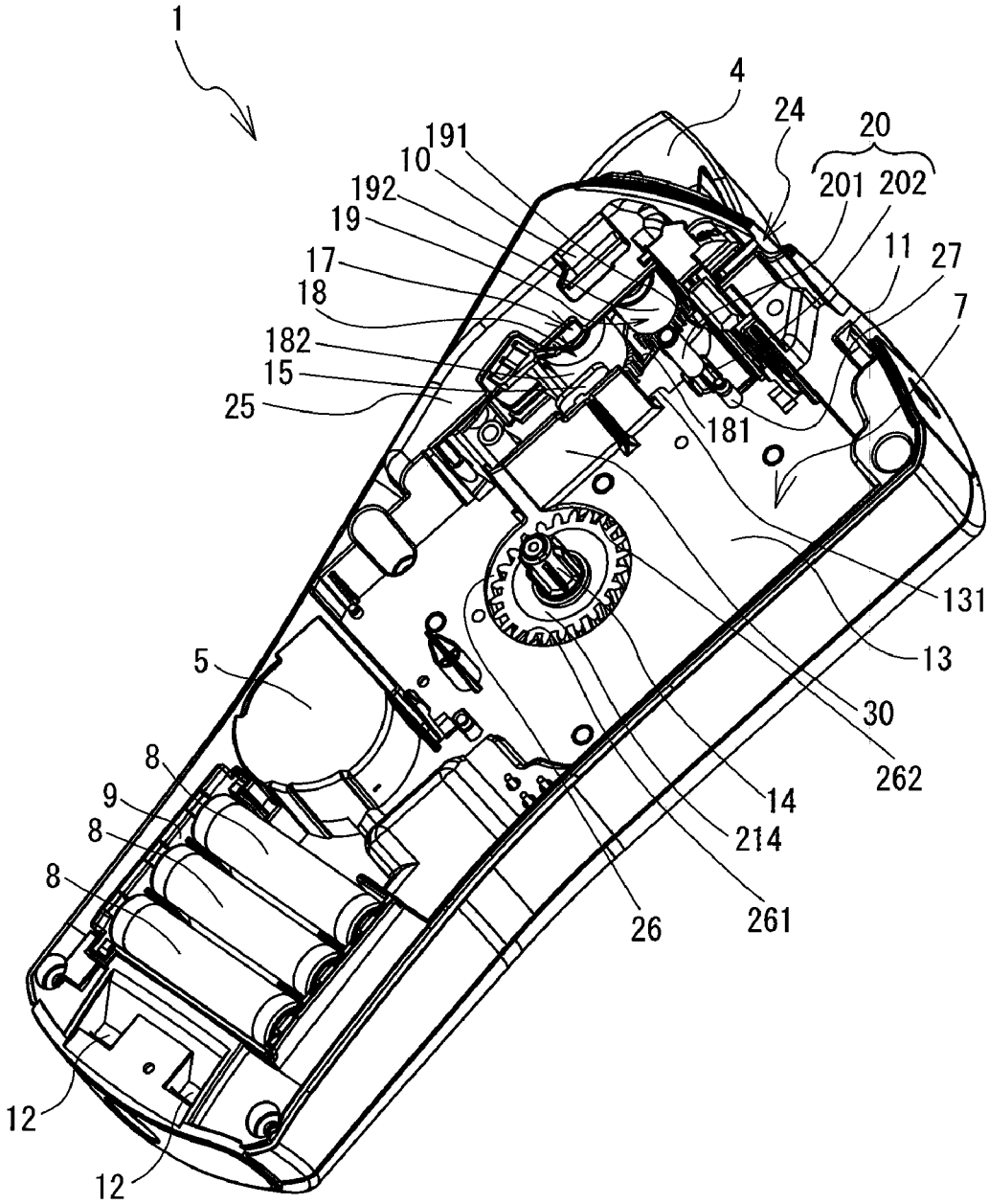
FIG. 4 is a perspective view from the bottom side of the tape printing device in a state in which the lower cover and the tape cassette are removed.

The bottom face structure of the tape printing device 1 when the lower cover 6 is removed therefrom will be described with reference to FIG. 3 and FIG. 4. In the following description, the upper right side in FIG. 3 and FIG. 4 is referred to as the backside of the tape printing device 1, the lower left side as the front side of the tape printing device 1, the lower right side as the right side of the tape printing device 1, and the upper left side as the left side of the tape printing device 1. The near side in the figures is referred to as the upper side of the tape printing device 1, and the far side as the lower side of the tape printing device 1.

As shown in FIG. 3 and FIG. 4, a cassette mounting portion 7 is provided at the back in the bottom face of the tape printing device 1. The cassette mounting portion 7 is formed in a concave shape for detachably loading a tape cassette 31 and is rectangular in top plan view. The tape cassette 31 is detachably loaded in the cassette mounting portion 7. A motor storage portion 5 for accommodating a motor 21 (see FIG. 6) is provided on the front side of the cassette mounting portion 7 (lower left side in FIG. 3 and FIG. 4). A battery storage portion 9 for accommodating dry cell batteries 8 is provided on the front side of the motor storage portion 5. The tape delivery slit 24 for discharging the label tape 80 to the outside is provided at the back of the cassette mounting portion 7. On the left side of the cassette mounting portion 7, and above the roller holder 17 to be described later, a plate-like synthetic resin plate 25 is provided. The projection insertion hole 10 is provided at the back of the plate 25. The projection insertion hole 10 is an opening. As the lower cover 6 is attached and removed, the projection 64 provided to the lower cover 6 is inserted to and extracted from the projection insertion hole 10. Thereby, the roller holder 17 to be described later can move to the printing position (see FIG. 12) or to the wait position (see FIG. 11). The movement of the roller holder 17 will be described in detail later.

The lock hole 11 is provided at the back in the bottom face of the tape printing device 1. At the front in the bottom face of the tape printing device 1, the lock holes 12 at two locations are provided. As mentioned above, when the lower cover 6 is attached, the engaging lock 62 and the lock members 63 provided to the lower cover 6 fit in the lock hole 11 and the two lock holes 12, respectively. This structure prevents the lower cover 6 from falling and opening on its own.

The cassette mounting portion 7 will be described. As shown in FIG. 4, the bottom face of the cassette mounting portion 7 is formed by a synthetic resin frame 13. One frame end 131, which is the left side end of the frame 13, is positioned on the left side of a rib 30 and a first support shaft 20 to be described later. At the substantial center of the frame 13, a gear recess 26 that is circular in top plan view and concave in side view is provided. A gear 214 is provided in the gear recess 26. A first gear recess hole 261 is formed at the front of the gear recess 26. The first gear recess hole 261 is an opening. The gear 214 is engaged with a gear 213 (see FIG. 5 to FIG. 8) provided on a lower side face of the frame 13 through the first gear recess hole 261. A second gear recess hole 262 is provided at the back of the gear recess 26. The second gear recess hole 262 is an opening. The gear 214 is engaged with a gear 215 (see FIG. 5 to FIG. 8) provided on the lower side face of the frame 13 through the second gear recess hole 262. A ribbon take-up shaft 14 for taking up an ink ribbon 55 (see FIG. 10) stands above the gear 214. With this structure, driving power from the motor 21 (see FIG. 6 to FIG. 8) is transmitted by the gear 213 to rotate the gear 214 and the ribbon take-up shaft 14. The transmission path of the driving power from the motor 21 will be described later. While FIG. 4 shows the teeth of the gear 214 in an exposed state for the sake of explanation, the teeth of the gear 214 are actually covered by a wall face of the frame 13 and not exposed.

As shown in FIG. 4, the rib 30 supporting a heat sink 15 stands on the left side of the ribbon take-up shaft 14. The heat sink 15 is a heat dissipating plate and is rectangular in side view. The heat sink 15 is provided on the left side face of the rib 30. A thermal head 16 (see FIG. 11 and FIG. 12) having a heat generating element is provided on the left side face of the heat sink 15. On the left side of the rib 30, further on the left side of the frame end 131, and below the plate 25, an arm-shaped roller holder 17 is provided (see FIG. 4, FIG. 11, and FIG. 12). The arm-shaped roller holder 17 is swingable in the direction of the heat sink 15 (lower right direction in FIG. 4). In the roller holder 17, a platen roller unit 18 and a press roller unit 19 are rotatably supported with shafts. When the lower cover 6 is attached, the projection 64 (see FIG. 2) presses the left side face of the roller holder 17, thereby moving the roller holder 17 toward the tape cassette 31 (lower right direction in FIG. 4). This moves the press roller unit 19 and the platen roller unit 18 provided in the roller holder 17 to the printing position (see FIG. 12). The roller holder 17 will be described in detail later.

As shown in FIG. 4, the platen roller unit 18 rotatably supported with a shaft in the roller holder 17 is disposed on the left side of the heat sink 15. The platen roller unit 18 has a platen roller 182 and a platen roller gear 181. The platen roller 182 is disposed at a position opposite the thermal head 16 (see FIG. 11 and FIG. 12) that is provided on the left side face of the heat sink 15. The platen roller gear 181 is disposed at a position opposite a gear 218 (see FIG. 5 to FIG. 8) provided on the lower side of the frame 13. When the platen roller unit 18 has moved to the printing position, the platen roller 182 is pressed against the thermal head 16 (see FIG. 12) through a transparent film tape 51 and the ink ribbon 55. The platen roller gear 181 is engaged with the gear 218 (see FIG. 6 to FIG. 8) provided on the lower side of the frame 13.

For printing the label tape 80, driving power from the motor 21 is transmitted to the gear 218, whereby the platen roller gear 181 is rotated. Rotating the platen roller gear 181 rotates the platen roller 182. While the transparent film tape 51 is pressed against the thermal head 16 by the platen roller 182, letters, graphics, symbols, and the like are printed on the transparent film tape 51 by the thermal head 16 and the ink ribbon 55. The printed transparent film tape 51 is fed out toward the tape delivery slit 24 provided at the back of the rib 30 by the rotation of the platen roller 182.

As shown in FIG. 4, the first support shaft 20 stands on the frame 13 between the rib 30 and the tape delivery slit 24. The first support shaft 20 is formed by a columnar column portion 201 and six support shaft ribs 202. The six support shaft ribs 202 are formed radially outwards on the outer circumference of the column portion 201. The first support shaft 20 fits into a shaft hole 391 (see FIG. 9) of a tape transfer roller 39 provided in the tape cassette 31 and rotatably supports the tape transfer roller 39. The first support shaft 20 is made of synthetic resin and formed integrally with the frame 13.

As shown in FIG. 4, a boss 27 stands on the right side of the first support shaft 20. The boss 27 fits into a cassette recess 43 (see FIG. 14) of the later-described tape cassette 31 to position the tape cassette 31 in the up-and-down direction.

On the left side of the first support shaft 20, further left of the frame end 131, the press roller unit 19 rotatably supported with a shaft in the roller holder 17 is disposed. The press roller unit 19 has a press roller 192 and a press roller gear 191. The press roller 192 is disposed at a position opposite the first support shaft 20. The press roller 192 is formed by providing synthetic resin such as rubber on the outer circumference of the center shaft of the press roller unit 19. The press roller gear 191 is disposed at a position opposite a gear 217 (see FIG. 5 to FIG. 8) provided on the lower side of the frame 13. When the press roller unit 19 has moved to the printing position (see FIG. 12), the press roller 192 is pressed against the tape transfer roller 39 that is rotatably supported on the first support shaft 20 through the transparent film tape 51 and a double sided adhesive tape 53 (see FIG. 12 to FIG. 14). The press roller gear 191 is engaged with the gear 217 provided on the lower side of the frame 13 (see FIG. 6 to FIG. 8).

For printing the label tape 80, driving power from the motor 21 is transmitted to the gear 217, whereby the press roller gear 191 is rotated. Rotating the press roller gear 191 rotates the press roller 192. The transparent film tape 51 and the double sided adhesive tape 53 are held and pressed together between the press roller 192 and the tape transfer roller 39 to become the label tape 80, which is then discharged from the tape delivery slit 24 to the outside of the tape printing device 1.

The driving power transmission path from the motor 21 provided in the tape printing device 1 will be described with reference to FIG. 5 to FIG. 8.

Figure 5:
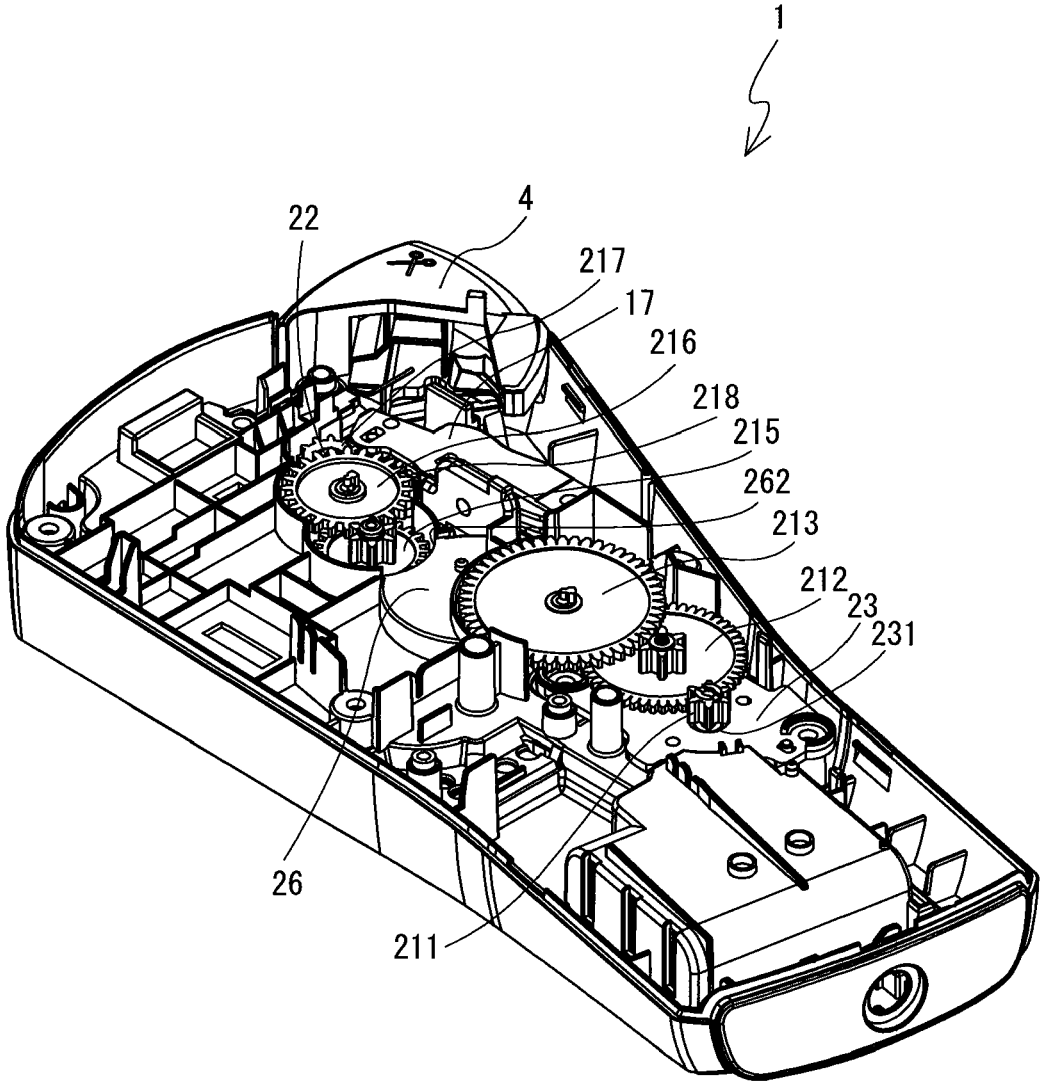
FIG. 5 is a perspective view showing the structure on the backside of the bottom face of the tape printing device shown in FIG. 4.
Figure 6:
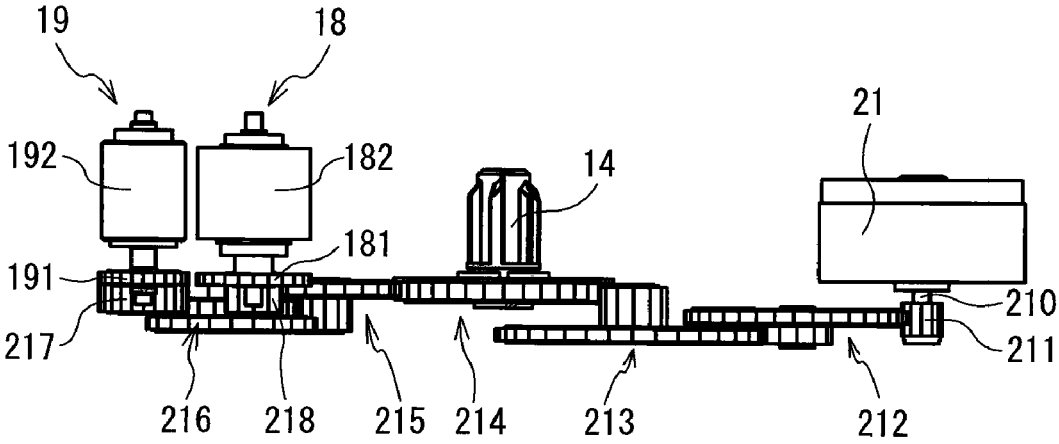
FIG. 6 is a schematic diagram showing the positional relationships between gears viewed from the left side of the tape printing device shown in FIG. 4.
Figure 7:
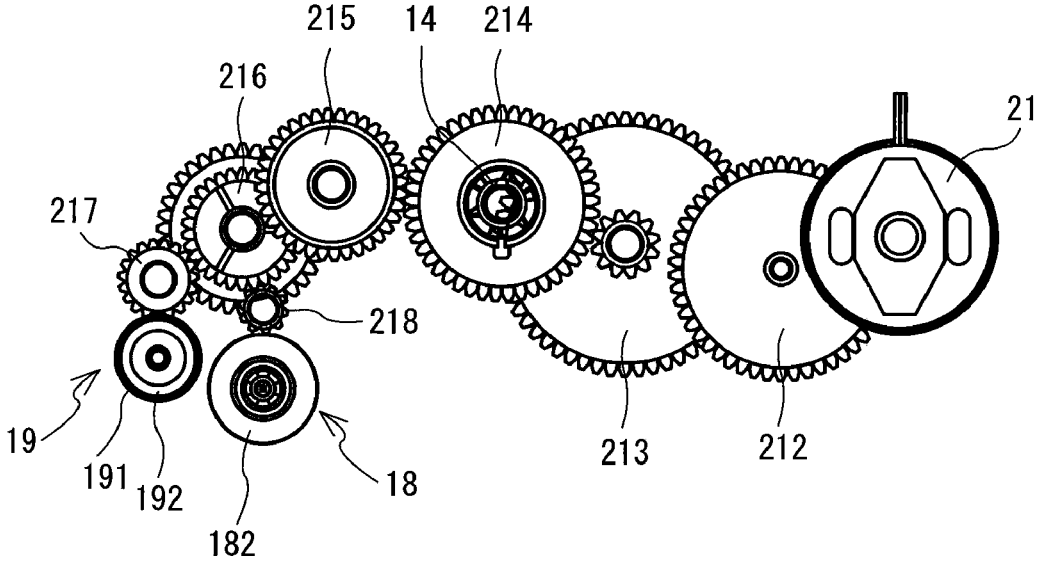
FIG. 7 is a plan view of the positional relationships between the gears of FIG. 6 viewed from above.
Figure 8:
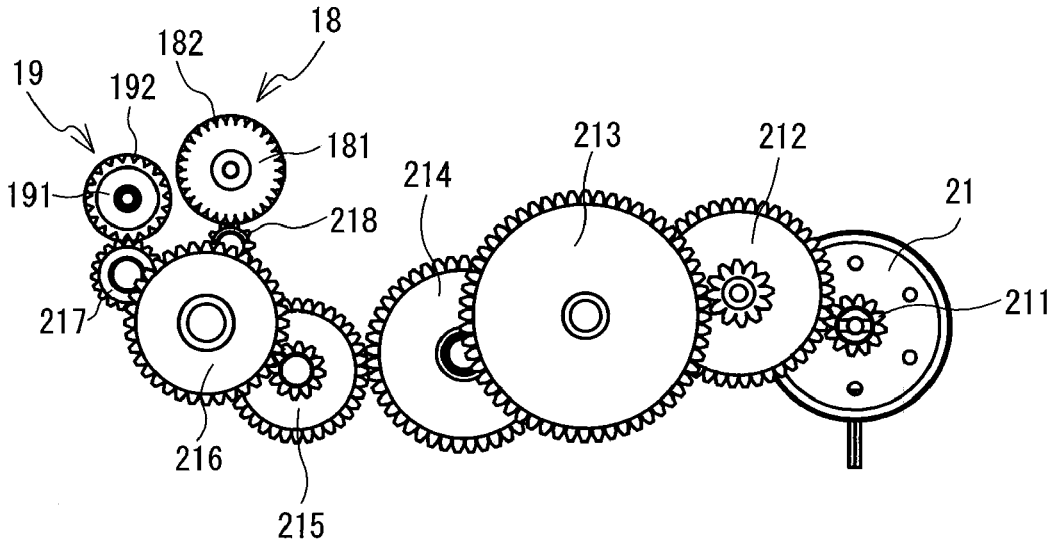
FIG. 8 is a plan view of the positional relationships between the gears of FIG. 6 viewed from below.

In FIG. 5, the near side is referred to as the lower side of the tape printing device 1, and the far side as the upper side of the tape printing device 1. In FIG. 6, the upper side is referred to as the upper side of the tape printing device 1, and the lower side as the lower side of the tape printing device 1. In FIG. 7, the near side is referred to as the upper side of the tape printing device 1, and the far side as the lower side of the tape printing device 1. In FIG. 8, the near side is referred to as the lower side of the tape printing device 1, and the far side as the upper side of the tape printing device 1. In FIG. 5 to FIG. 8, the roller holder 17 has moved to the printing position (see FIG. 12).

On the lower side face of the frame 13 provided in the cassette mounting portion 7 shown in FIG. 4, gears 212, 213, and 215 to 217 are provided as shown in FIG. 5. The gear 214 is provided in the gear recess 26 (see FIG. 4 and FIG. 5), i.e., disposed on the surface on the side of the cassette mounting portion 7 (see FIG. 4). As shown in FIG. 5, the lower side face of the frame 13 is formed such as to be able to dispose the gears 212 to 218.

The motor 21 (see FIG. 6 to FIG. 8) is provided on the lower side of the motor storage portion 5 (on the far side in FIG. 3 and FIG. 4). A drive gear 211 (see FIG. 5, FIG. 6, and FIG. 8) is fixedly attached to a drive shaft 210 (see FIG. 6) of the motor 21. As shown in FIG. 5, a motor storage cover 23 is provided on the lower side of the motor 21 (on the near side in FIG. 5), so that the motor 21 is accommodated between the motor storage portion 5 and the motor storage cover 23. The motor storage cover 23 includes a cover hole 231 which is a circular opening in top plan view. The drive gear 211 is disposed on the lower side (on the near side in FIG. 5) of the motor storage cover 23 through the cover hole 231 provided in the motor storage cover 23.

The drive gear 211 is engaged with the gear 212 (see FIG. 5, FIG. 6, and FIG. 8). The gear 212 is engaged with the gear 213 (see FIG. 5, FIG. 6, and FIG. 8). The gear 213 is engaged with the gear 214 (see FIG. 6 and FIG. 7) provided on the surface on the side of the cassette mounting portion 7 through the first gear recess hole 261 (see FIG. 4) provided in the gear recess 26. The ribbon take-up shaft 14 (see FIG. 4, FIG. 6, and FIG. 7) for rotating a ribbon take-up spool 57 (see FIG. 10) stands on the gear 214. The ribbon take-up spool 57 will be described later. The gear 214 is engaged with the gear 215 (see FIG. 6 to FIG. 8) through the second gear recess hole 262 (see FIG. 4 and FIG. 5) provided in the gear recess 26. The gear 215 is engaged with the gear 216 (see FIG. 5, FIG. 6, and FIG. 8). The gear 216 is engaged with the gear 217 and the gear 218 (see FIG. 6 and FIG. 7). The gear 217 is provided on the outer circumference of a second support shaft 22 (see FIG. 5 and FIG. 14) that stands on the lower side face of the frame 13. The gear 217 rotates around the second support shaft 22. The second support shaft 22 does not rotate with the gear 217 because it is formed integrally with the frame 13. The second support shaft 22 is provided on the frame 13 on the opposite side of the first support shaft 20. The second support shaft 22 is made of synthetic resin.

Figure 12:
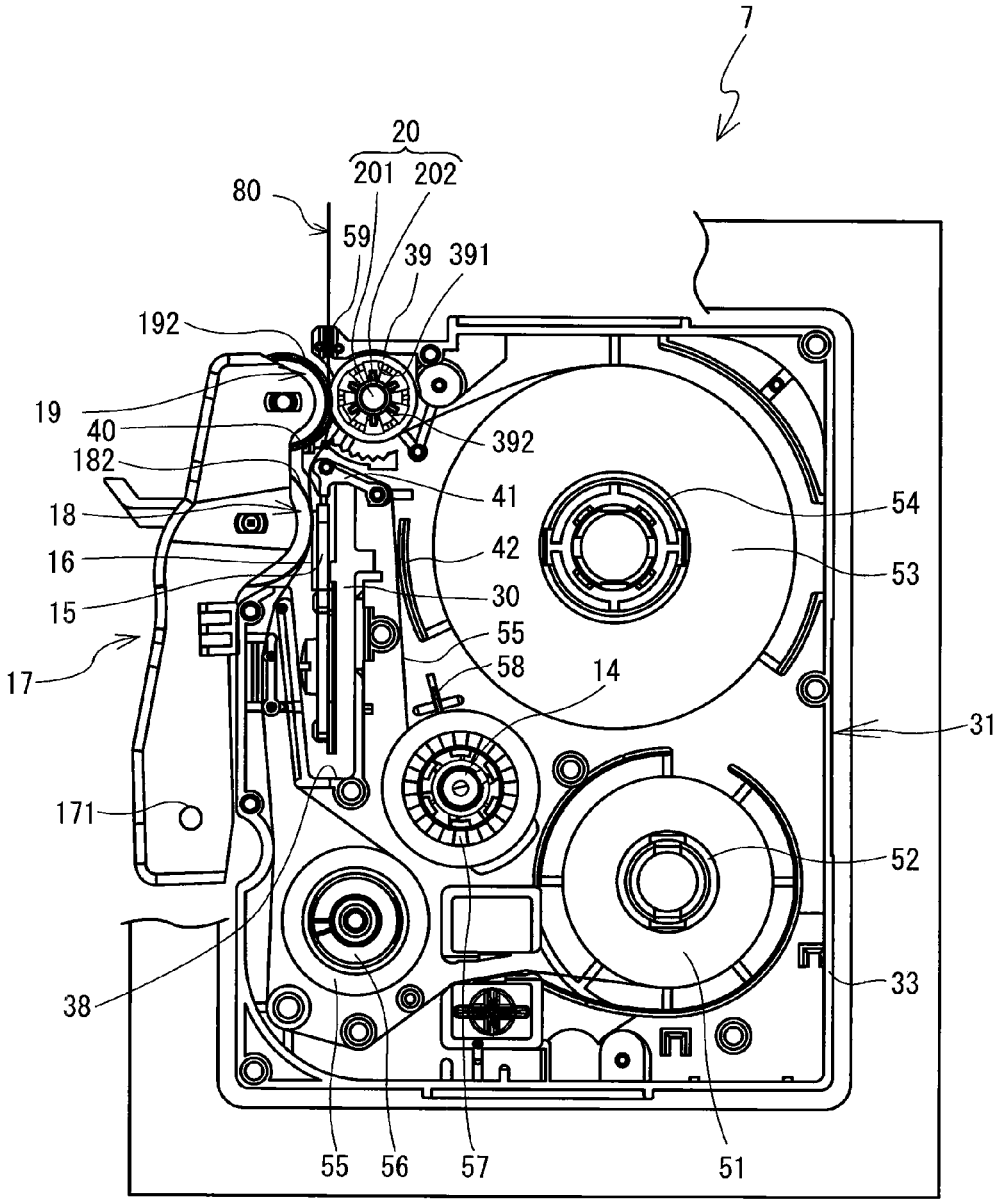
FIG. 12 is a plan view of the cassette mounting portion in a state in which the tape cassette has been loaded and the roller holder has moved to its printing position.

When the lower cover 6 is attached, the press roller unit 19 and the platen roller unit 18 move to the printing position (see FIG. 12). At this time, the press roller gear 191 provided in the lower part of the press roller unit 19 is biased toward the gear 217 and engaged with the same (see FIG. 6, FIG. 8, and FIG. 14). The platen roller gear 181 provided in the lower part of the platen roller unit 18 is biased toward the gear 218 and engaged with the same (see FIG. 6 and FIG. 8). How the press roller gear 191 and the platen roller gear 181 are biased will be described later.

With the tape cassette 31 being loaded in the cassette mounting portion 7, when the motor 21 rotates, the gear 214 rotates through the drive gear 211 and the gears 212 and 213, as shown in FIG. 5 to FIG. 8. Rotating the gear 214 rotates the ribbon take-up shaft 14 standing on the gear 214. The ribbon take-up shaft 14 is fitted in the ribbon take-up spool 57 to be described later (see FIG. 11 and FIG. 12). Thereby, the rotation of the ribbon take-up shaft 14 rotates the ribbon take-up spool 57. The rotation of the gear 214 is transmitted to the gears 217 and 218 through the gears 215 and 216. The rotation of the gear 217 is transmitted to the press roller gear 191 and rotates the same. The rotation of the press roller gear 191 rotates the press roller 192. The rotation of the gear 218 is transmitted to the platen roller gear 181 and rotates the same. The rotation of the platen roller gear 181 rotates the platen roller 182.

Figure 9:
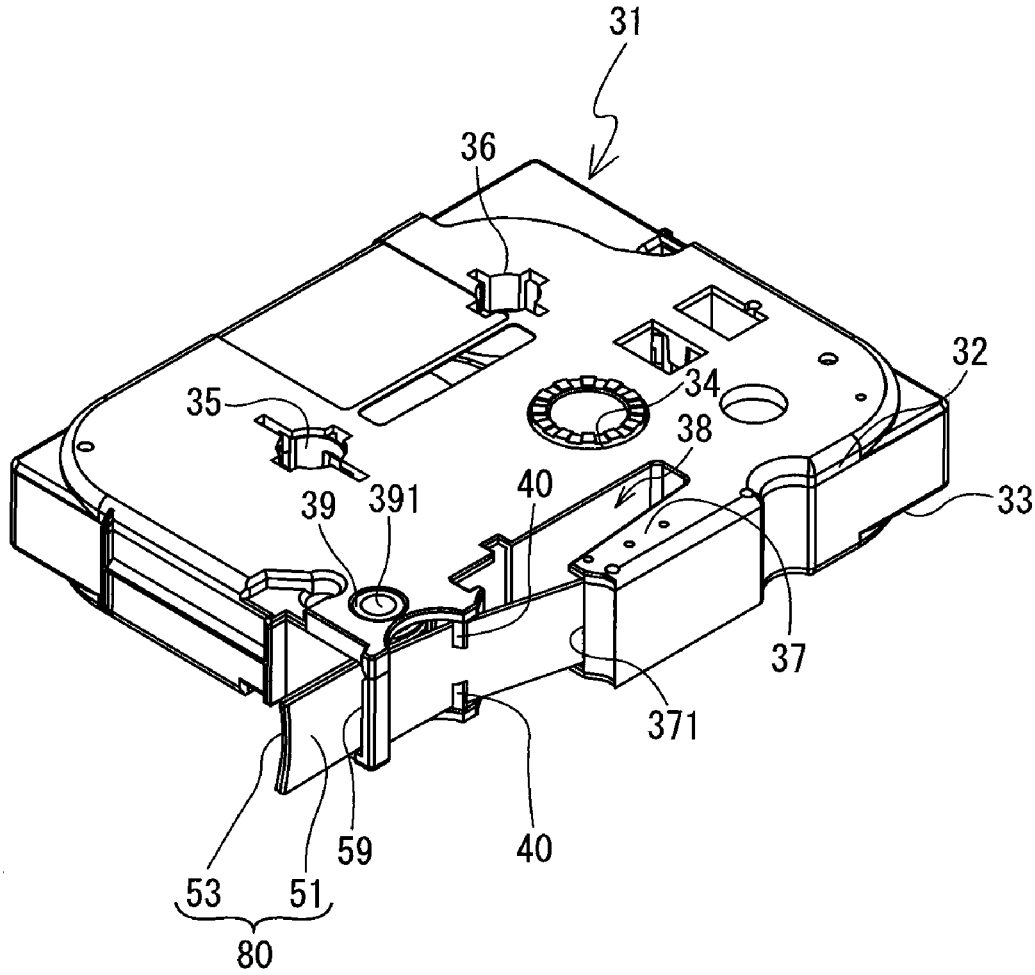
FIG. 9 is a perspective view of the tape cassette.
Figure 10:
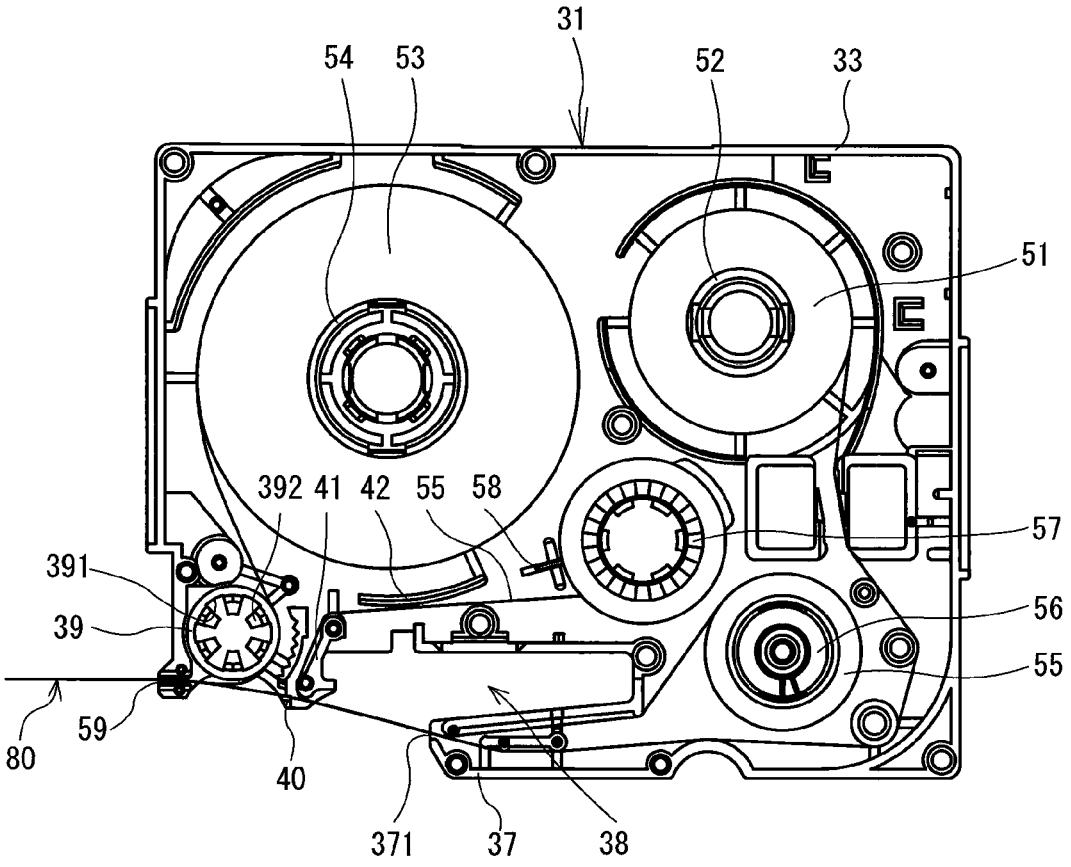
FIG. 10 is a plan view of a lower cassette case from which an upper cassette case has been removed.

The tape cassette 31 loaded in the cassette mounting portion 7 of the tape printing device 1 will be described with reference to FIG. 9 and FIG. 10. The tape cassette 31 discharges the so-called laminate type label tape 80. In the following description, the lower right side in FIG. 9 is referred to as the front side of the tape cassette 31, the upper left side as the backside of the tape cassette 31, the upper right side as the right side of the tape cassette 31, and the lower left side as the left side of the tape cassette 31. The near side in the figures is referred to as the upper side of the tape cassette 31, and the far side as the lower side of the tape cassette 31.

First, the outer structure of the tape cassette 31 will be described with reference to FIG. 9. As shown in FIG. 9, the tape cassette 31 is composed of an upper cassette case 32 and a lower cassette case 33. The tape cassette 31 includes a support hole 34 rotatably supporting the ribbon take-up spool 57 (see FIG. 10), a support hole 35 rotatably supporting a double sided adhesive tape spool 54 (see FIG. 10), and a support hole 36 rotatably supporting a tape spool 52 (see FIG. 10). Although FIG. 9 illustrates only the support holes 34, 35, and 36 formed in the upper cassette case 32, the lower cassette case 33 similarly includes with respective support holes 34, 35, and 36 opposite the support holes 34, 35, and 36 in the upper cassette case 32.

As shown in FIG. 9, the tape cassette 31 has an arm portion 37 at the front. The arm portion 37 guides the transparent film tape 51 drawn out from the tape spool 52 and the ink ribbon 55 drawn out from the ribbon spool 56 (see FIG. 10) and feeds them out from a cassette hole 371 which is an opening.

A head mounting portion 38 is provided at the back of the arm portion 37. The heat sink 15 having the thermal head 16 (see FIG. 11 and FIG. 12) is mounted on the head mounting portion 38. A pair of upper and lower restricting members 40 are provided downstream of the head mounting portion 38 in the transfer direction of the transparent film tape 51 and the ink ribbon 55. The restricting members 40 restrict the printed transparent film tape 51, in the widthwise direction on the downstream side of the thermal head 16.

As shown in FIG. 9, the tape transfer roller 39 is provided downstream of the restricting members 40 in the transfer direction of the transparent film tape 51. A cylindrical shaft hole 391 is provided in the center of the tape transfer roller 39 for inserting therein the first support shaft 20. The shaft hole 391 is formed with six shaft hole ribs 392 (see FIG. 10 and FIG. 13) extending from the inner wall of the shaft hole 391 toward the center. The shaft hole ribs 392 will be described later. The tape transfer roller 39 and the press roller 192 press together the transparent film tape 51 and the double sided adhesive tape 53 in cooperation with each other to form the label tape 80. They then feed out the tape label 80 toward a tape discharge port 59 provided downstream of the tape transfer roller 39 in the tape transfer direction. The label tape 80 passes through the tape discharge port 59 and is discharged from the tape delivery slit 24 to the outside (see FIG. 3) provided in the tape printing device 1.

Figure 14:
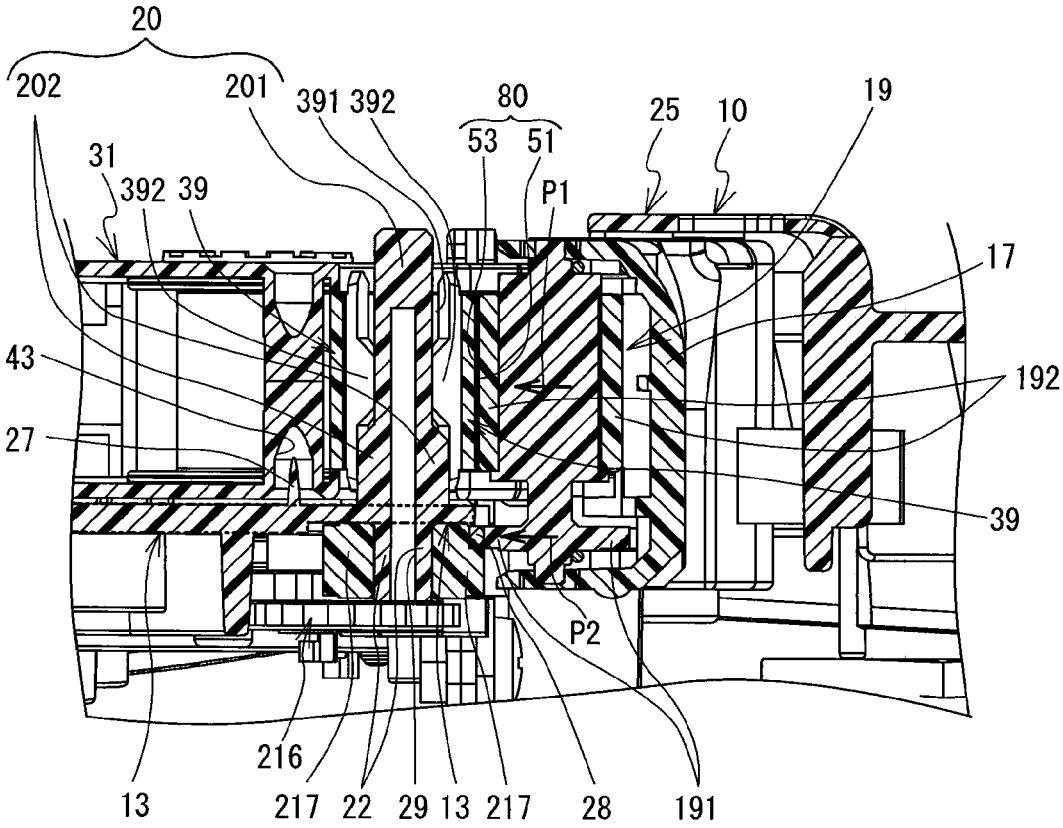
FIG. 14 is a partial cross-sectional view taken along the line as viewed from the direction of arrows of FIG. 13.

The cassette recess 43 is formed at the back of the tape transfer roller 39 in the lower cassette case 33 (see FIG. 14). The boss 27 (see FIG. 4) fits in the cassette recess 43, thereby to achieve the positioning in the up and down direction of the tape cassette 31.

The inner structure of the tape cassette 31 will be described with reference to FIG. 10. As shown in FIG. 10, the tape spool 52 on which the transparent film tape 51 is wound is rotatably provided in the back on the right side of the lower cassette case 33. The transparent film tape 51 is guided toward the cassette hole 371 and fed out from the cassette hole 371.

The ribbon spool 56 is rotatably provided in the front on the right side of the lower cassette case 33. The ribbon spool 56 is wound the ink ribbon 55. The ink ribbon 55 is guided toward the cassette hole 371 and fed out from the cassette hole 371.

The ribbon take-up spool 57 is rotatably provided between the tape spool 52 and the ribbon spool 56. The ribbon take-up spool 57 draws out the ink ribbon 55 from the ribbon spool 56 as well as takes up the ink ribbon 55 after the ink has been consumed by printing of letters or the like. A clutch spring 58 is attached to a lower part of the ribbon take-up spool 57. The clutch spring 58 prevents from the ribbon take-up spool 57 reversing and prevents the wound ink ribbon 55 from slackening.

A guide wall 41 stands near the restricting members 40. The guide wall 41 separates the used ink ribbon 55 transferred via the head mounting portion 38 from the transparent film tape 51 and guides the ink ribbon toward the ribbon take-up spool 57. A separation wall 42 stands between the guide wall 41 and the ribbon take-up spool 57. The separation wall 42 prevents the used ink ribbon 55, which is guided along the guide wall 41, and the double sided adhesive tape 53, which is wound around and supported by the double sided adhesive tape spool 54, from contacting each other.

The double sided adhesive tape spool 54 is rotatably disposed in the back on the left side of the lower cassette case 33. The double sided adhesive tape spool 54 is wound the double sided adhesive tape 53. The double sided adhesive tape 53 is guided toward the tape transfer roller 39. The double sided adhesive tape 53 and the transparent film tape 51 are pressed together by the tape transfer roller 39 and the press roller 192 to become the label tape 80, which is then fed out toward the tape discharge port 59.

Figure 11:
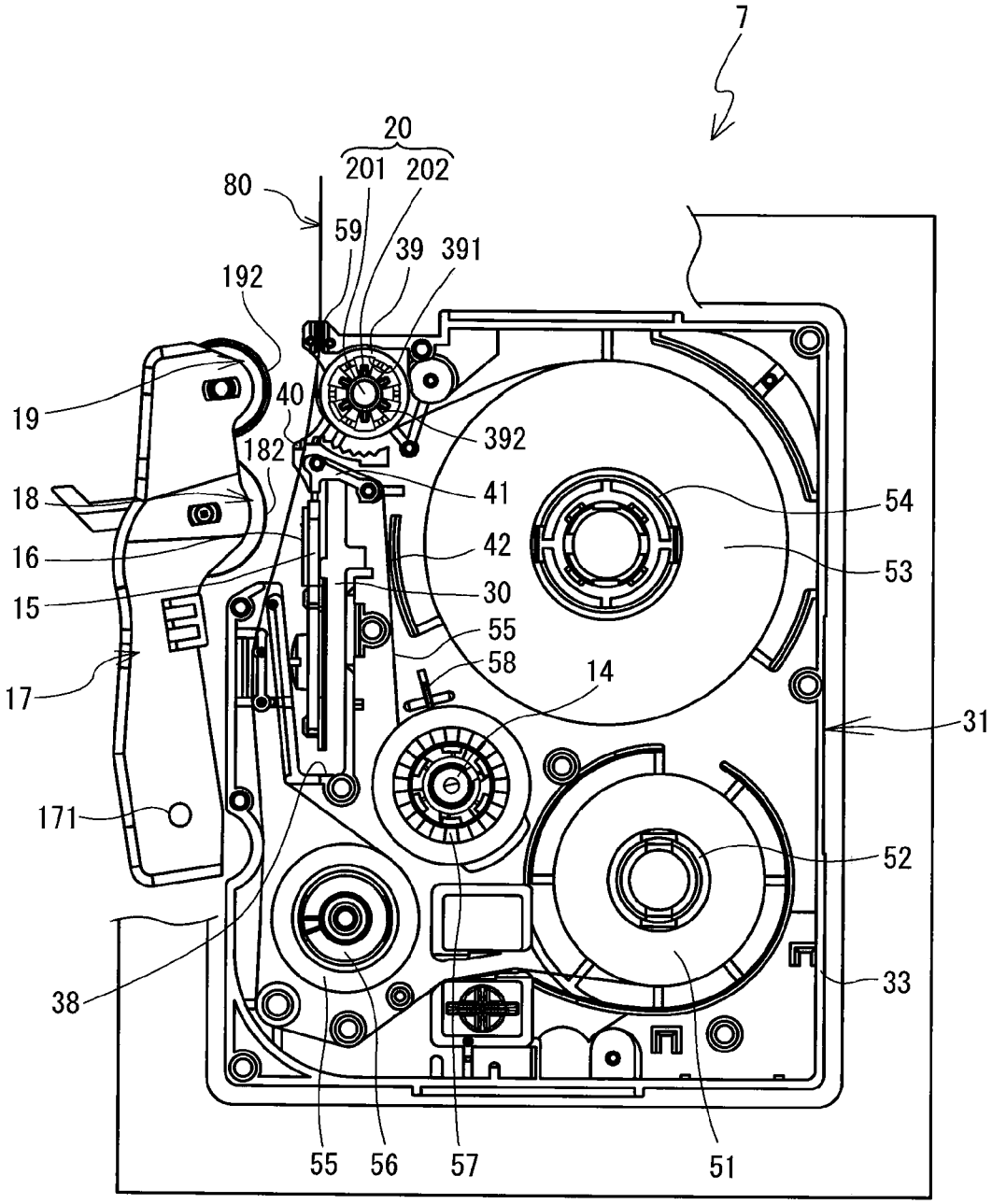
FIG. 11 is a plan view of a cassette mounting portion in a state in which the tape cassette 31 has been loaded and a roller holder has moved to its wait position.

The roller holder 17 will be described with reference to FIG. 11 and FIG. 12. In FIG. 11 and FIG. 12, the lower side is referred to as the front side of the tape printing device 1, the upper side as the backside of the tape printing device 1, the right side as the right side of the tape printing device 1, and the left side as the left side of the tape printing device 1. The near side in the figures is referred to as the upper side of the tape printing device 1, and the far side as the lower side of the tape printing device 1. In FIG. 11 and FIG. 12, various elements that have already been described are indicated by the same reference numerals, and they will not be described here.

As shown in FIG. 11 and FIG. 12, on the left side of the tape cassette 31 loaded in the cassette mounting portion 7 of the tape printing device 1, the arm-like roller holder 17 having the platen roller unit 18 and the press roller unit 19 is supported with a shaft such as to be swingable around a pivot portion 171. The roller holder 17 is always resiliently biased toward the wait position away toward the left side from the tape cassette 31 shown in FIG. 11 by a coil spring (not shown). Therefore, when the lower cover 6 is removed, the roller holder 17 is in its wait position shown in FIG. 11.

As shown in FIG. 11 and FIG. 12, the press roller unit 19 is rotatably supported with a shaft at the back of the roller holder 17 (upper side in FIG. 11 and FIG. 12). The press roller unit 19 is disposed at a position opposite the tape transfer roller 39. The platen roller unit 18 is rotatably supported with a shaft in the roller holder 17 in front of the press roller unit 19 (lower side in FIG. 11 and FIG. 12). The platen roller unit 18 is disposed at a position opposite the thermal head 16 provided on the left side face of the heat sink 15.

The press roller unit 19 and the platen roller unit 18 are provided in the roller holder 17 such as to be respectively movable left and right within a predetermined width. The roller holder 17 includes a bias spring (not shown) for resiliently biasing the press roller unit 19 and the platen roller unit 18 toward the tape cassette 31 (right direction in FIG. 11 and FIG. 12). The press roller unit 19 is provided in the roller holder 17 in a state in which it is biased by the bias spring toward the tape transfer roller 39 (right direction in FIG. 11 and FIG. 12). The platen roller unit 18 is provided in the roller holder 17 in a state in which it is biased by the bias spring toward the thermal head 16 (right direction in FIG. 11 and FIG. 12).

When the lower cover 6 (see FIG. 2) is attached to the tape printing device 1, the projection 64 (see FIG. 2) provided on the lower cover 6 fits in the projection insertion hole 10 (see FIG. 3 and FIG. 4) and presses the left side face of the roller holder 17 to the right side. The roller holder 17 pressed by the projection 64 to the right side moves to the printing position near the tape cassette 31 shown in FIG. 12. The platen roller 182 provided in the platen roller unit 18 biases and presses the thermal head 16 disposed on the left side face of the heat sink 15 through the transparent film tape 51 and the ink ribbon 55. The platen roller gear 181 provided in the lower part of the platen roller unit 18 is biased toward the gear 218 and engaged with the same (see FIG. 6 and FIG. 8). At this time, the platen roller unit 18 is pressing the thermal head 16 and the gear 218 by the biasing force of the bias spring.

As shown in FIG. 12, the press roller 192 provided in the press roller unit 19 biases and presses the tape transfer roller 39 through the transparent film tape 51 and the double sided adhesive tape 53. The press roller gear 191 provided in the lower part of the press roller unit 19 is biased toward the gear 217 and engaged with the same (see FIG. 6 and FIG. 8). At this time, the press roller unit 19 is pressing the tape transfer roller 39 and the gear 217 by the biasing force of the bias spring. Here, as the tape transfer roller 39 is pressed by the press roller 192, the first support shaft 20 retaining the tape transfer roller 39 in its position is pressed.

By this structure, when the roller holder 17 moves to the printing position shown in FIG. 12, printing can be performed using the tape cassette 31 loaded in the cassette mounting portion 7.

When the lower cover 6 is removed, the projection 64 is released from the projection insertion hole 10, whereby the roller holder 17 moves by the biasing force of the coil spring to the wait position shown in FIG. 11 and waits there.

A series of operations from the loading of the tape cassette 31 to the discharging of the label tape 80 that can be performed with the structure described above will be explained.

First, the tape cassette 31 is loaded in the cassette mounting portion 7 (see FIG. 3), and the lower cover 6 is attached. When the lower cover 6 is attached, the projection 64 (see FIG. 2) fits into the projection insertion hole 10 (see FIG. 3 and FIG. 4). Thereby, the roller holder 17 is pushed by the projection 64 and moves from the wait position (see FIG. 11) to the printing position (see FIG. 12). Thus the platen roller unit 18 and the press roller unit 19 provided in the roller holder 17 move to the printing position. The platen roller gear 181 provided in the lower part of the platen roller unit 18 engages with the gear 218 (see FIG. 6 and FIG. 8). The platen roller 182 provided in the platen roller unit 18 biases and presses the thermal head 16 provided on the left side face of the heat sink 15 (see FIG. 12) through the transparent film tape 51 and the ink ribbon 55. At this time, the platen roller unit 18 is pressing the thermal head 16 and the gear 218 by the biasing force of the bias spring.

The press roller gear 191 provided in the lower part of the press roller unit 19 engages with the gear 217 (see FIG. 6 and FIG. 8). The press roller 192 provided in the press roller unit 19 presses the tape transfer roller 39 (see FIG. 12) through the transparent film tape 51 and the double sided adhesive tape 53. At this time, the press roller unit 19 is pressing the tape transfer roller 39 and the gear 217 by the biasing force of the bias spring. As the tape transfer roller 39 is pressed by the press roller 192, the first support shaft 20 retaining the tape transfer roller 39 in its position is pressed.

When printing operation is started, the motor 21 rotates. As shown in FIG. 5 to FIG. 8, the rotation of the motor 21 rotates the drive gear 211 fixedly attached to the drive shaft 210, the gears 212 to 218, the platen roller gear 181, and the press roller gear 191. With this rotation, the ribbon take-up shaft 14, the platen roller 182, and the press roller 192 that are connected to these gears also rotate. The rotation of the ribbon take-up shaft 14 rotates the ribbon take-up spool 57 provided to the tape cassette 31 (see FIG. 12).

By the driving power from the motor 21 thus transmitted, the transparent film tape 51 is drawn out from the tape spool 52, the double sided adhesive tape 53 is drawn out from the double sided adhesive tape spool 54, and the ink ribbon 55 is drawn out from the ribbon spool 56, as shown in FIG. 12. The drawn-out transparent film tape 51 and the ink ribbon 55 are pressed by the platen roller 182 against the thermal head 16. Printing is done on the print surface of the transparent film tape 51 by the thermal head 16 and the ink ribbon 55. The tape is then fed toward the tape transfer roller 39.

As shown in FIG. 12, the used ink ribbon 55 is separated from the transparent film tape 51 by the guide wall 41, guided toward the ribbon take-up spool 57 and is then wound on the ribbon take-up spool 57.

As shown in FIG. 12, the double sided adhesive tape 53 and the printed transparent film tape 51 are held and pressed together between the tape transfer roller 39 and the press roller 192 to become the label tape 80. The label tape 80 is fed toward the tape discharge port 59 and discharged to the outside from the tape delivery slit 24 (see FIG. 3) via the tape discharge port 59.

Figure 13:
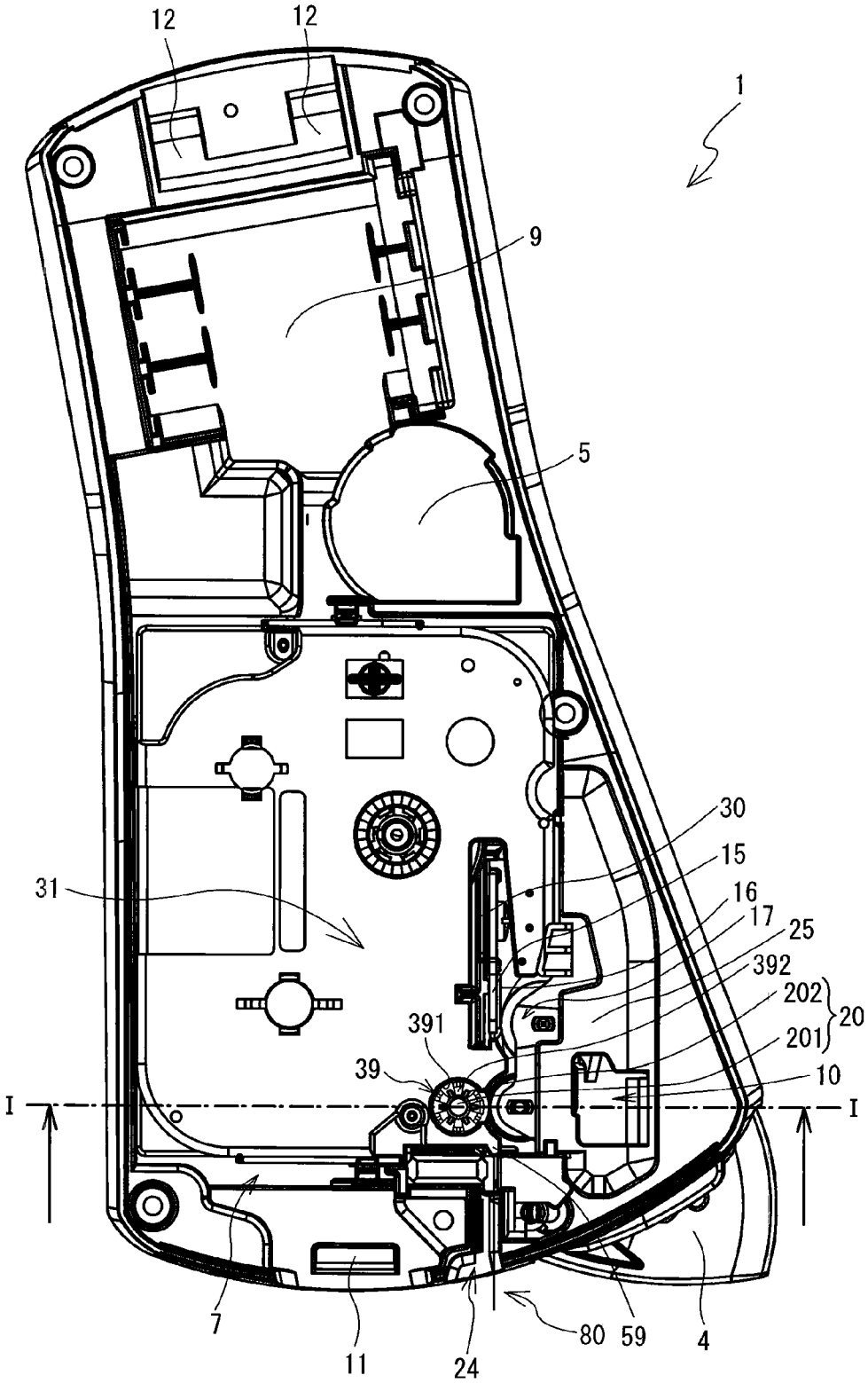
FIG. 13 is a plan view from the bottom side of the tape printing device in a state in which the tape cassette is loaded and the lower cover is removed.

Next, the structures of the frame 13, the first support shaft 20, the second support shaft 22, the gear 217, and the press roller unit 19 will be described with reference to FIG. 13 and FIG. 14. In the following description, the near side in FIG. 13 is referred to as the upper side of the tape printing device 1, and the far side as the lower side of the tape printing device 1. The upper side in FIG. 14 is referred to as the upper side of the tape printing device 1, and the lower side as the lower side of the tape printing device 1. In FIG. 13 and FIG. 14, various elements that have already been described are indicated by the same reference numerals, and they will not be described here.

In FIG. 13 and FIG. 14, the platen roller unit 18 and the press roller unit 19 rotatably supported with shafts in the roller holder 17 have moved to the printing position. Although the lower cover 6 and the projection 64 are not shown, the roller holder 17 has been pressed by the projection 64 and moved to the printing position.

As shown in FIG. 14, the frame 13 supports the tape cassette 31. The first support shaft 20 stands on the upper side of the frame 13. As shown in FIG. 13 and FIG. 14, the first support shaft 20 is fitted in the shaft hole 391 provided in the tape transfer roller 39. As mentioned above, the first support shaft 20 is formed by the columnar column portion 201 and six support shaft ribs 202 radially and outwardly extending from the outer circumference in the lower part of the columnar column portion 201.

As shown in FIG. 13, six shaft hole ribs 392 are provided in the shaft hole 391 of the tape transfer roller 39. The six shaft hole ribs 392 are formed to extend radially towards the center from the inner wall of the shaft hole 391. As shown in FIG. 14, the shaft hole ribs 392 are provided at a position higher than the support shaft ribs 202 formed in the lower part of the first support shaft 20. Therefore, the shaft hole ribs 392 and the support shaft ribs 202 do not contact each other.

As shown in FIG. 13 and FIG. 14, the tape cassette 31 is loaded on the upper side of the frame 13, with the first support shaft 20 being fitted in the shaft hole 391 provided in the tape transfer roller 39. At this time, the shaft hole ribs 392 are making contact with the columnar column portion 201 of the first support shaft 20, thereby positioning the tape transfer roller 39. The six support shaft ribs 202 are formed such as not to contact the tape transfer roller 39 at this time. By this structure, the tape transfer roller 39 is rotatably positioned by the first support shaft 20.

As shown in FIG. 14, the cylindrical second support shaft 22 stands on the frame 13 at the position opposite from the first support shaft 20. The frame 13, the first support shaft 20, and the second support shaft 22 are all integrally formed from synthetic resin. A cavity 29 is formed from a central portion of the second support shaft 22 through the frame 13 to a central portion of the first support shaft 20.

The gear 217 is rotatably provided on the outer circumference of the second support shaft 22. As mentioned above, the gear 217 rotates by the driving power transmitted from the motor 21. The second support shaft 22 is integrally formed with the frame 13 and so does not rotate.

As mentioned above, when the lower cover 6 is attached, the projection 64 formed on the lower cover 6 fits in the projection insertion hole 10. The roller holder 17 is pressed by the projection 64 and moves to the printing position (see FIG. 12 and FIG. 13). This causes the press roller gear 191 disposed in the lower part of the press roller unit 19 to engage with the gear 217 (see FIG. 6, FIG. 8, and FIG. 14). In FIG. 14, the press roller gear 191 and the gear 217 are engaging each other at an engaging portion 28.

As shown in FIG. 14, the press roller 192 provided above the press roller gear 191, while it holds down the transparent film tape 51 and the double sided adhesive tape 53, is biased toward the tape transfer roller 39 (direction of arrow P1 in FIG. 14), to press the tape transfer roller 39. The press roller unit 19 is biased by the biasing force of the bias spring mentioned above. Therefore, the press roller 192 presses the tape transfer roller 39 in the direction indicated by the arrow P1 in FIG. 14 by the biasing force of the bias spring. The press roller gear 191 presses the gear 217 in a direction indicated by arrow P2 by the biasing force of the bias spring mentioned above.

The tape transfer roller 39 that is pressed by the press roller 192 in the direction of the arrow P1 is biased toward the first support shaft 20 that is retaining the tape transfer roller 39 in its position and presses the first support shaft 20. The gear 217 that is pressed by the press roller gear 191 in the direction of the arrow P2 is biased toward the second support shaft 22 that is retaining the gear 217 and presses the second support shaft 22.

As mentioned above, when printing out the label tape 80, the driving power from the motor 21 is transmitted to the press roller gear 191 and rotates the same, whereby the press roller 192 provided above the press roller gear 191 is rotated. With this structure, the transparent film tape 51 and the double sided adhesive tape 53 are held and pressed together between the press roller 192 and the tape transfer roller 39 to become the label tape 80. The label tape 80 is fed toward the tape delivery slit 24 (see FIG. 13) and discharged to the outside via the tape discharge port 59 (see FIG. 13) by the rotation of the press roller 192 and the tape transfer roller 39.

At this time, the tape transfer roller 39 is rotatably positioned by the first support shaft 20. The tape transfer roller 39 is rotatable. Therefore, the tape transfer roller 39 rotates, as the press roller 192 rotates while pressing the tape transfer roller 39 in the direction of the arrow P1 (see FIG. 14) thereby discharging the label tape 80. Thereby, although the first support shaft 20 does not rotate, the double sided adhesive tape 53 and the transparent film tape 51 can be pressed together and discharged to the outside as the label tape 80.

With the structure described above, the tape printing device 1 of this embodiment can produce the label tape 80. As shown in FIG. 14, the press roller unit 19 is biased by the biasing force of the bias spring. Therefore, the press roller 192 is biased in the direction of the arrow P1. The press roller gear 191 is biased in the direction of the arrow P2. Pressure from the press roller 192 provided in the press roller unit 19 (biasing force in the direction of the arrow P1) is applied to the first support shaft 20 provided on the upper side of the frame 13, through the transparent film tape 51, the double sided adhesive tape 53, and the tape transfer roller 39. Pressure from the press roller gear 191 provided in the lower part of the press roller unit 19 (biasing force in the direction of the arrow P2) is applied to the second support shaft 22 through the gear 217 provided on the lower side of the frame 13. That is, the pressure from the press roller unit 19 is dispersed and applied to the first support shaft 20 on the upper side of the frame 13 and to the second support shaft 22 on the lower side of the frame 13. Therefore, the pressure applied to each of the first support shaft 20 and the second support shaft 22 is smaller as compared to the case where the pressure from the press roller unit 19 is applied only to one support shaft. Since the pressures applied to the first support shaft 20 and the second support shaft 22 are small, the first support shaft 20 and the second support shaft 22 do not tilt even though they are made of synthetic resin, which is a material lower in strength than metal.

On the other hand, in the case where the second support shaft 22 is not provided, the pressure from the press roller 192 is applied only to the first support shaft 20. In this case, the pressure that is applied only to the first support shaft 20 applies force to the frame 13 that is supporting the first support shaft 20. The force applied from the first support shaft 20 to the frame 13 contains an upward force component. If the frame 13 is made of synthetic resin, this upward force will cause the frame 13 to warp upwards because the synthetic resin is low in strength.

In this embodiment, as shown in FIG. 14, the first support shaft 20 stands on the upper side of the frame 13, while the second support shaft 22 stands on the lower side of this frame. The pressure from the press roller unit 19 is dispersed and applied to each of the support shafts. The force applied to the frame 13 from the first support shaft 20 contains an upward force component. On the other hand, the force applied to the frame 13 from the second support shaft 22 contains a downward force component. These upward and downward forces cancel each other. Therefore, the upward or downward force applied to the frame 13 is reduced. Accordingly, even though the frame 13 is made of synthetic resin, it does not warp.

As mentioned above, the pressure from the press roller unit 19 is dispersed and applied to the first support shaft 20 and the second support shaft 22. Therefore, the pressure applied to each of the first support shaft 20 and the second support shaft 22 is smaller as compared to the case where the pressure from the press roller unit 19 is applied only to one support shaft. The upward force applied from the first support shaft 20 to the frame 13 and the downward force applied from the second support shaft 22 to the frame 13 cancel each other. Therefore, the upward or downward force applied to the frame 13 is reduced. Accordingly, even though the first support shaft 20, the second support shaft 22, and the frame 13 are made of synthetic resin, the first support shaft 20 and the second support shaft 22 do not tilt, and the frame 13 does not warp. Therefore, even when pressure is applied from the press roller unit 19, the tape transfer roller 39 can be retained in an appropriate position. As the tape transfer roller 39 is retained in an appropriate position, the double sided adhesive tape 53 and the transparent film tape 51 are smoothly pressed together and discharged to the outside as the label tape 80. Since the first support shaft 20, the second support shaft 22, and the frame 13 are made of synthetic resin, the production cost can be reduced as compared to making them from metal.

It goes without saying that the structures shown in this embodiment are merely examples and various modifications can be made to the disclosure. For example, while the second support shaft 22 is disposed on the frame 13 on the opposite side of the first support shaft 20 in this embodiment, it may be disposed offset from the position of the first support shaft 20, on the opposite side face of the first support shaft 20. While the first support shaft 20 is provided with six support shaft ribs 202 in its lower part in this embodiment, the number of the support shaft ribs 202 may be changed as desired. Or, the support shaft ribs 202 may be omitted. While the tape cassette 31 in this embodiment is a tape cassette that discharges the so-called laminate type label tape 80, other tape cassettes that discharge, for example, label tapes not being of laminate type, such as a so-called non-laminate type label tape or cloth tape, may be used.

What is claimed is:

1. A printing device detachably loading a tape cassette which includes a label forming a printing medium, a rotatable tape transfer roller discharging the label to the outside, and a shaft hole provided in the tape transfer roller, the printing device comprising:

a motor provided within the printing device;

a first support shaft that is made of synthetic resin and is fitted in the shaft hole to rotatably support the tape transfer roller;

a frame that is made of synthetic resin and anchors a lower part of the first support shaft;

a second support shaft that is made of synthetic resin standing on the frame on the opposite side of the first support shaft;

a first gear that is rotatably provided around an outer circumference of the second support shaft to be rotated by driving power transmitted from the motor;

a second gear that engages with the first gear and biased toward the first gear; and a press roller that includes the second gear, rotates by driving power transmitted through the second gear, and is biased toward the first support shaft to hold the label between itself and the tape transfer roller and to discharge the label to the outside.

* * * * *